United States Patent [19]

O'Connor

[11] 4,437,583

[45] Mar. 20, 1984

[54] DRIBBLE RING

[75] Inventor: Rodney J. O'Connor, College Station, Tex.

[73] Assignee: Romec Environmental Research & Development, Inc., College Station, Tex.

[21] Appl. No.: 332,547

[22] Filed: Dec. 21, 1981

[51] Int. Cl.[3] ..... B67D 1/16

[52] U.S. Cl. ..... 222/108; 116/206; 215/100.5

[58] Field of Search ..... 215/100.5; 116/206, 116/216; 374/162; 422/55, 58, 99, 102; 222/108

[56] References Cited

U.S. PATENT DOCUMENTS

| | | | |
|---|---|---|---|
| 447,635 | 3/1891 | Day, Jr. . | |
| 1,103,985 | 7/1914 | Murray et al. | 422/55 |
| 1,182,993 | 5/1916 | Deeks . | |
| 1,891,892 | 12/1932 | Pipkin . | |
| 2,115,654 | 4/1938 | Swofford . | |
| 2,568,623 | 9/1951 | Hamm . | |
| 2,685,318 | 9/1954 | Merkle . | |
| 2,779,495 | 1/1957 | Davis | 215/100.5 |
| 2,918,033 | 12/1959 | Snyder | 116/206 |
| 2,918,893 | 12/1959 | Norton | 116/206 |
| 3,063,590 | 11/1962 | Hopkins | 215/100.5 |
| 3,819,036 | 6/1974 | Weldon | 206/216 |

FOREIGN PATENT DOCUMENTS

| | | | |
|---|---|---|---|
| 330769 | 8/1958 | Switzerland | 222/108 |

*Primary Examiner*—David A. Scherbel

*Attorney, Agent, or Firm*—Pravel, Gambrell, Hewitt, Kirk & Kimball

[57] ABSTRACT

The invention disclosed is a band or layer of absorbent material which is wrapped around the outside of a liquid container to entrap and hold waste liquid dripping down the sides of the container. The absorbent material is impregnated with a neutralizing agent selected to chemically neutralize the liquid of the container and a chemical indicator which changes color as excess liquid from the container accumulates in the absorbent material.

15 Claims, 3 Drawing Figures

DRIBBLE RING

FIELD OF THE INVENTION

The invention relates to an apparatus designed to collect and trap liquid running down the sides of liquid containers that are repeatedly used for dispensing fluids.

PRIOR ART

Liquid running down the sides of a liquid container is an annoying byproduct of pouring a fluid from most containers. Frequently, such run-down dribble is nothing more than a nuisance or irritation, sometimes requiring that the liquid be wiped up. But in the case of hazardous and toxic fluids, run-down dribble can become a safety hazard to human tissue as well as being destructive to furniture and the like. If the liquid is a corrosive or toxic fluid, waste liquids on the sides of the container may prove to be a real safety hazard causing damage to human tissue when the container is handled. Accumulations of hazardous waste liquid may form on the sides of the liquid container itself and on the surfaces upon which the liquid container rests. Such corrosive and toxic deposits prove destructive to counter tops and shelf surfaces as well as human tissue.

In attempting to provide relief from the problem of waste fluid dripping down the sides of liquid containers, the prior art has developed apparatus to catch run-down dribble. U.S. Pat. Nos. 447,635; 1,182,993 and 3,063,590 disclose collars of absorbent material to be placed around the neck of a bottle to catch drippings. U.S. Pat. No. 3,819,036 describes a box which encloses the liquid container to catch hazardous chemicals within the box and protect the person using the container. Jackets and coasters to catch dripping condensation from the exterior of bottles and glasses are disclosed in U.S. Pat. Nos. 1,891,892; 2,115,654; 2,568,623; 2,685,318 and 2,779,495. However, none of the above cited patents disclose the use of an agent to chemically neutralize the waste liquid as it is trapped in the drip catching apparatus or the use of a chemical indicator which changes color as excess liquid from the container accumulates in the drip catching apparatus.

SUMMARY OF THE INVENTION

The present invention solves the problem of liquid dripping down the sides of liquid containers by entrapping the waste liquid and holding it until the waste liquid can be disposed of properly. The invention comprises a band or layer of absorbent material which is wrapped around the outside of the liquid container. The absorbent material may be impregnated with a neutralizing agent selected to chemically neutralize the liquid of the container as well as an indicator which changes color as excess liquid from the container accumulates in the absorbent material.

DETAILED DESCRIPTION

Figure 1:
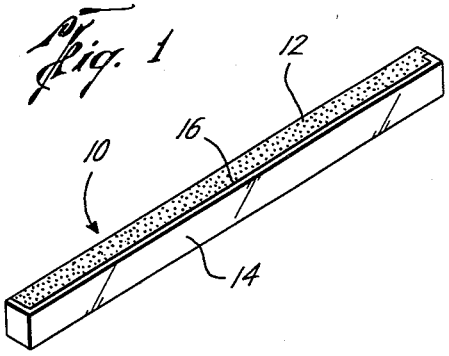
FIG. 1 is a cross-sectional view of the preferred embodiment illustrating a strip of absorbent material.

By capturing and holding run-down dribble, the present invention completely eliminates the problem of waste liquid dripping down the side of a container after liquid has been poured from the container. The use of hazardous liquids becomes safer when the invention is used to entrap and neutralize waste liquid dribbling down the side of the container. Besides laboratory and industrial uses, the dribble ring may be advantageously employed for hazardous fluids such as battery acids in service stations, reagents in photographic laboratories and liquid drain cleaners and household ammonia solutions in the home. The present invention may also be used for non-hazardous liquids such as soft drinks and syrups. The absorbent material impregnated with a neutralizing agent and an indicator agent can be employed around the liquid container in several shapes. The preferred embodiment of the invention comprises a strip of foam rubber partially encased with a transparent plastic covering which can be cut to the desired length, wrapped around the container in the shape of a ring and secured with tape. A hollow cylinder of foam with a wrapping of transparent plastic or rubber is a second embodiment designed to encompass the liquid container. Alternate embodiments to the ring and the hollow cylinder include conical and cubical shapes of absorbent material. Although the ring embodiment will be discussed throughout the description, it should be understood that the invention includes other embodiments and that subsequent discussions of the preferred ring embodiment are also applicable to the alternate embodiments.

The absorbent material is preferably a deformable foam rubber or a plastic foam which will contact the entire circumference of a container when in place. Other fibrous materials which will absorb liquids may also be used. In the preferred embodiments of this invention, the foam is partially encased in a thin transparent covering of stretchable rubber or plastic which retains the entrapped liquid within the foam. With some reagents, such as perchloric acid, that could react dangerously with rubber or plastics, a suitable inert substitute for the foam rubber or plastic foam can be used. A teflon foam encased with a teflon plastic covering is preferred for such reagents.

The foam layer is saturated with a neutralizing agent or an adsorbent and allowed to dry. The neutralizing agent is selected to chemically neutralize the specific liquid of the liquid receptacle. The use of a neutralizing agent permits the dribble ring to absorb a greater quantity of waste liquid. An adsorbent may be used in the foam to neutralize nonaqueous solvents.

The absorbent material is also preferably permeated with an indicator chemical which reacts with the liquid and changes color when an excess of waste liquid has been absorbed by the foam layer. For example, a foam impregnated with a base for a neutralizing chemical and litmus for an indicator, will turn red when all of the neutralizing agent has reacted with the waste acid, alerting a user that the dribble ring has reached the end of its life and is ready for disposal. Disposal directions may be printed directly on the transparent covering to read, for example, "When red coloring predominates, cut off and dispose of ring with gloves." The change in foam color indicates that the ring has reached its saturation limit. In an alternate embodiment, a strip of indicator material, such as pH paper or litmus, is wrapped around the absorbent material. Examples of various indicators that may be used include litmus, phenolphthalein, methyl red, an iodide-starch indicator and a metal salt indicator.

It should be appreciated that many neutralizing agent and indicator mixtures may be employed in the invention. Listed combinations are merely disclosed as examples and should not be interpreted as limiting the invention. For non-oxidizing acids such as concentrated hydrochloric acid, sodium phosphate, along with an indicator such as methyl red, may be utilized. Glycine and aluminum hydroxide are both excellent neutralizing agents for acids or bases and may be used in combination with litmus. Aluminum hydroxide, in particular, is preferred because of its gel-like quality that enables it to adhere nicely to foam materials. A dribble ring for alkaline solutions may be saturated with sodium bicarbonate or sodium dihydrogen phosphate with phenolphthalein as an indicator. The phenolphthalein will turn the foam from colorless to red as excess alkalis accumulate in the foam material. Ion-exchange resins with a strip of indicator material such as pH paper wrapped around the absorbent material may also be employed for acids and bases.

For mild oxidizing agents such as dilute hydrogen peroxide or dilute potassium permanganate, sodium bisulfite may be used with an iodide-starch indicator. Such an indicator turns the foam blue as excess oxidizing agent accumulates in the absorbent material. For fluorides such as hydrofluoric acid or ammonium fluoride, a good neutralizing agent and indicator mixture is sodium silicate with a metal salt indicator selected to form a colored fluoride complex with the metal cations and excess accumulated fluoride ions. With a strong oxidizing agent such as perchloric acid, a teflon foam layer can be impregnated with a suitable reducing agent and an oxidation-reduction indicator.

FIG. 1 illustrates a cross-sectional view of the dribble ring 10. A deformable absorbent layer 12 is partially encased by a transparent plastic or rubber coating 14 which covers the side and the bottom of the ring to retain the waste liquid within the foam 12. The top of the foam layer 12 is open to the air to allow for the waste liquid dripping down the sides of the container to enter the foam layer 12 and to allow for evaporation of water from the foam 12 between uses of the container. A strip of indicator material 16 such as pH paper may be optionally placed between the absorbent layer 12 and the transparent cover 14, eliminating the need to impregnate the absorbent layer 12 with an indicator chemical.

Figure 2:
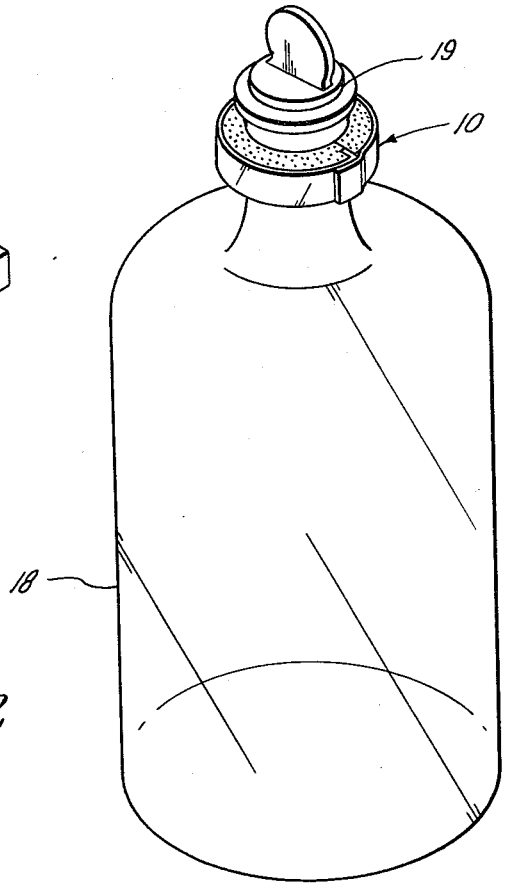
FIG. 2 is a perspective view illustrating the strip of FIG. 1 wrapped around the neck of a reagent bottle.

A typical chemical reagent bottle 18 is shown in FIG. 2. The preferred embodiment of the ring 10 is shown wrapped around the neck of the bottle 18 directly below liquid outlet 19 of the reagent bottle 18.

Figure 3:
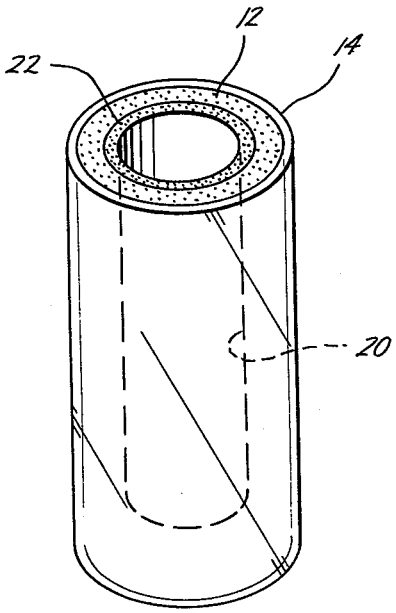
FIG. 3 is a perspective view illustrating an alternate cylindrical embodiment of the invention.

An alternate embodiment of the dribble ring comprising a hollow cylindrical container is illustrated in FIG. 3. The foam layer is shown at 12 encased by transparent plastic cover 14. The interior hollow 20 of the cylinder is shaped to receive the liquid container. Transparent cover 14 covers most of the top of the cylinder except for a thin layer of foam 22 immediately encircling the liquid container and open to the atmosphere and liquid dripping from the container outlet.

The foregoing disclosure and description of the invention are illustrative and explanatory thereof and various changes in the size, shape and materials as well as in the details of the illustrated invention may be made without departing from the scope of the invention.

I claim:

1. An apparatus for capturing liquid dripping down the sides of a liquid container, which comprises:

an absorbent material wrapped around the outside of a liquid container; and said absorbent material being impregnated with a chemical agent selected to chemically neutralize the liquid dripping down the sides of the liquid container.

2. The apparatus of claim 1, wherein the neutralizing agent is selected from the group consisting of sodium phosphate, aluminum hydroxide, glycine, sodium bicarbonate, sodium dihydrogen phosphate, sodium bisulfite, sodium silicate and ion-exchange resins.

3. The apparatus of claim 1, further including a strip of an indicator material wrapped around the absorbent material, said indicator material selected to change color as excess liquid from the container accumulates in the absorbent material.

4. The apparatus of claim 1, wherein the chemical agent includes an indicator which changes color as excess liquid from the container accumulates in the absorbent material.

5. The apparatus of claim 4, wherein the indicator is selected from the group consisting of methyl red, phenolphthalein, iodide-starch indicator, metal salt indicator and litmus.

6. The apparatus of claim 4, further including a neutralizing agent selected to chemically neutralize liquid from the container.

7. The apparatus of claim 6, wherein the neutralizing agent is sodium phosphate and the indicator is methyl red when the liquid is a non-oxidizing acid.

8. The apparatus of claim 6, wherein the neutralizing agent is sodium bicarbonate and the indicator is phenolphthalein when the liquid is alkaline.

9. The apparatus of claim 6, wherein the neutralizing agent is sodium dihydrogen phosphate and the indicator is phenolphthalein when the liquid is alkaline.

10. The apparatus of claim 6, wherein the neutralizing agent is sodium bisulfite and the indicator is an iodide-starch indicator when the liquid is an oxidizing agent.

11. The apparatus of claim 6, wherein the neutralizing agent is sodium silicate and the indicator is a metal salt indicator when the liquid contains fluoride ions.

12. The apparatus of claim 1, further including a transparent material wrapped around the absorbent material to entrap the liquid from the container within the absorbent material.

13. The apparatus of claim 1, wherein the apparatus is a ring around the liquid container near a liquid outlet of the container.

14. The apparatus of claim 1, wherein the apparatus is a hollow cylinder designed to fit around the liquid container.

15. An apparatus for capturing liquid dripping down the sides of a liquid container, which comprises:

a ring of absorbent material wrapped around the outside of a liquid container;

a transparent material wrapped around the absorbent material to entrap the liquid from the container within the absorbent material;

said absorbent material being impregnated with a neutralizing agent and an indicator, said neutralizing agent selected to chemically neutralize liquid from the container, and said indicator selected to change color as excess liquid from the container accumulates in the absorbent material.

* * * * *